US011540975B2

(12) United States Patent
Kloke et al.

(10) Patent No.: US 11,540,975 B2
(45) Date of Patent: Jan. 3, 2023

(54) DEVICE AND PROCESS FOR STOPPERING FROM BELOW

(71) Applicant: SCHOTT Schweiz AG, St. Gallen (CH)

(72) Inventors: Arne Kloke, St.Gallen (CH); Anil-Kumar Busimi, St.Gallen (CH); Dominique Bauert, St.Gallen (CH)

(73) Assignee: SCHOTT Schweiz AG, St. Gallen (CH)

( * ) Notice: Subject to any disclaimer, the term of this patent is extended or adjusted under 35 U.S.C. 154(b) by 0 days.

(21) Appl. No.: 17/038,674

(22) Filed: Sep. 30, 2020

(65) Prior Publication Data

US 2021/0093510 A1 Apr. 1, 2021

(30) Foreign Application Priority Data

Sep. 30, 2019 (EP) ..... 19200617

(51) Int. Cl.
*A61J 1/20* (2006.01)
*B67C 3/22* (2006.01)

(52) U.S. Cl.
CPC ..... *A61J 1/2003* (2015.05); *B67C 3/22* (2013.01)

(58) Field of Classification Search
CPC ..... B65B 7/00; B65B 7/28; B65B 7/2821; B65B 3/12; B67B 1/04; B67B 1/045; B67C 3/22; A61J 1/2003
USPC ..... 141/270; 53/451
See application file for complete search history.

(56) References Cited

U.S. PATENT DOCUMENTS

| | | | | |
|---|---|---|---|---|
| 2,353,985 | A | 7/1944 | Barr | |
| 3,737,973 | A * | 6/1973 | Stawski | B65B 7/2821 29/407.1 |
| 4,256,153 | A * | 3/1981 | Lamaziere | B01L 3/0227 141/238 |
| 5,519,984 | A * | 5/1996 | Beussink | B65B 3/003 53/324 |
| 6,250,052 | B1 * | 6/2001 | Porfano | B65B 55/027 53/425 |
| 10,279,935 | B2 * | 5/2019 | Hohmann | A61C 5/62 |
| 2006/0168916 | A1 | 8/2006 | Griebel | |

(Continued)

FOREIGN PATENT DOCUMENTS

| | | |
|---|---|---|
| DE | 1161168 | 1/1964 |
| DE | 202017103606 | 8/2018 |

(Continued)

*Primary Examiner* — Timothy L Maust
(74) *Attorney, Agent, or Firm* — Ruggiero McAllister & McMahon LLC

(57) ABSTRACT

A device is provided that accommodates elongate receptacles and charges. The device includes a superior surface, a first positioning device, a detaining device, and either a pusher or a second positioning device. The first positioning device is adapted and arranged to accommodate a pairing of a charge and a corresponding elongate receptacle. The pusher is moveable along a direction towards the superior surface to introduce the charge into the elongate receptacle. The second positioning device accommodates the pusher with the second positioning device and the pusher being moveable along the direction towards the superior surface to introduce the charge into the elongate receptacle. The detaining device limits the extent of movement of the pusher towards the superior surface.

17 Claims, 8 Drawing Sheets

(56) References Cited

U.S. PATENT DOCUMENTS

| | | | | |
|---|---|---|---|---|
| 2015/0122693 | A1* | 5/2015 | Deutschle | B65D 1/36<br>206/562 |
| 2016/0101881 | A1* | 4/2016 | Wright | A61B 17/12186<br>128/202.16 |
| 2018/0134423 | A1* | 5/2018 | Narvekar | B65B 55/20 |

FOREIGN PATENT DOCUMENTS

| | | |
|---|---|---|
| EP | 3398631 | 11/2018 |
| EP | 8536362 | 9/2019 |
| JP | H02280764 | 11/1990 |
| WO | 2016166769 | 10/2016 |

* cited by examiner

DEVICE AND PROCESS FOR STOPPERING FROM BELOW

CROSS REFERENCE TO RELATED APPLICATION

This application claims benefit under 35 USC 119 of European Application 19200617.9 filed Sep. 30, 2019, the entire contents of which are incorporated herein by reference.

BACKGROUND

1. Field of the Invention

The invention generally relates to a device adapted and arranged to accommodate elongate receptacles and charges and having a detaining device. The invention relates more specifically to a device, a process, a plurality of filled elongate receptacles and a use of a process or a device.

2. Description of Related Art

Pharmaceutical material can be provided in a number of forms and contained in a variety of different containers. In the case of a liquid pharmaceutical material, some common examples are ampules, vials, cartridges and syringes. A number of attempts have been made to provide automated processes to filling elongate receptacles with pharmaceutical material and stoppering them. Some of these attempts are based on so called nests, which hold containers or stoppers in a regular array for ease of processing.

One example of an attempt employing nests is WO 2016 166769 A1, in which a nest containing closures is aligned over a nest containing cartridges in order to transfer the closures to the cartridges.

German utility patent DE 20 2017 103 606 U1 discloses the use of vents in the elongate receptacles of a nest for improving the evacuation of gas from the elongate receptacles when the nest is operated in a vacuum.

U.S. Pat. No. 5,519,984 discloses the use of a tube for temporary insertion into a syringe during stoppering.

There is still a need to provide improved processes and devices for filling and stoppering elongate receptacles, in particular for pharmaceutical applications. For pharmaceutical products, precision and accuracy of filling and dosage can be a priority.

SUMMARY

Generally, the object of the present invention is to at least partially overcome one or more disadvantages in the state of the art, in particular in relation to the filling and closing of elongate receptacles.

It is an object of the present invention to provide a device for closing an elongate receptacle with a more consistent available fill height.

It is an object of the present invention to provide a device for producing a filled elongate receptacle with a more consistent product fill height.

It is an object of the present invention to provide a process for closing an elongate receptacle with a more consistent available fill height.

It is an object of the present invention to provide a process for producing a filled elongate receptacle with a more consistent product fill height.

It is an object of the present invention to provide a device for producing a filled elongate receptacle with a better controlled dosage of a medicament.

It is an object of the present invention to provide a process for producing a filled elongate receptacle with a better controlled dosage of a medicament.

It is an object of the present invention to provide a device for closing an elongate receptacle with a reduced need for configuration.

It is an object of the present invention to provide a process for closing an elongate receptacle with a reduced need for configuration.

It is an object of the present invention to provide a device for closing an elongate receptacle with a reduced reliance on additional equipment.

It is an object of the present invention to provide a process for closing an elongate receptacle with a reduced reliance on additional equipment.

The following embodiments are preferred embodiments of this disclosure.

In a first embodiment, a device is provided that includes a superior surface; one or more first positioning device, each adapted and arranged to accommodate a pairing of: a charge, and ii. a corresponding elongate receptacle; a detaining device; and either: one or more pusher, each pusher adapted and arranged to be moveable along a direction towards the superior surface to introduce an accommodated charge into a corresponding elongate receptacle, wherein the detaining device limits the extent of movement of the pusher towards the superior surface, or one or more second positioning device adapted and arranged for accommodating one or more pusher such that the pusher are each moveable along a direction towards the superior surface to introduce an accommodated charge into a corresponding elongate receptacle, wherein the detaining device limits the extent of movement of the pusher towards the superior surface.

The device according to one or more of the afore mentioned embodiments, wherein either: the device comprises one or more of the pusher, wherein one or more of the pusher, preferably each of the pusher, is moveable in a direction normal to the superior surface, or one or more second positioning device, each adapted and arranged for accommodating a pusher such that the pusher is moveable in a direction normal to the superior surface.

The device according to one or more of the afore mentioned embodiments, wherein one or more of the first positioning device, preferably each of the first positioning device, is adapted and arranged to accommodate a pairing of: a charge, and a corresponding elongate receptacle; such that the elongate receptacle has an elongate extension in a direction normal to the superior surface.

The device according to one or more of the afore mentioned embodiments, wherein one or more of the first positioning device, preferably each of the first positioning device, is adapted and arranged to accommodate a pairing of: a charge, and a corresponding elongate receptacle; such that the charge is located on an axis defined by an elongate extension of the elongate receptacle.

The device according to one or more of the afore mentioned embodiments, wherein the device is adapted and arranged to be operated with the superior surface horizontal.

The device according to one or more of the afore mentioned embodiments, wherein the device is adapted and arranged to be operated with one or more of the following fulfilled: One or more of the elongate receptacles, preferably each of the elongate receptacles, is below the superior surface; One or more of the charges, preferably each of the charges, is below the superior surface; One or more of the pusher, preferably each of the pusher, is below the superior surface; One or more of the charges, preferably each of the charges, is below the corresponding elongate receptacle; One or more of the pusher, preferably each of the pusher, is below a corresponding elongate receptacle; One or more of the pusher, preferably each of the pusher, is below a corresponding charge, and any combinations thereof.

The device according to one or more of the afore mentioned embodiments, wherein one or more of the first positioning device, preferably each of the first positioning device, is adapted and arranged to accommodate a pairing of a charge, and a corresponding elongate receptacle; such that the charge is outside the corresponding elongate receptacle.

The device according to one or more of the afore mentioned embodiments, device according to one or more of the afore or aft mentioned embodiments, wherein one or more of the first positioning device, preferably each of the first positioning device, is adapted and arranged to accommodate a pairing of a charge, and a corresponding elongate receptacle; such that the charge is at least partially inside the corresponding elongate receptacle. In one aspect of this embodiment, the charge is fully inside the elongate receptacle.

The device according to one or more of the afore mentioned embodiments, wherein one or more of the first positioning device, preferably each of the first positioning device, has an accommodated paring of: a charge, and a corresponding elongate receptacle.

The device according to one or more of the afore mentioned embodiments, wherein one or more of the charges, preferably each of the charges, is adapted and arranged to close an inferior aperture of the corresponding elongate receptacle.

The device according to one or more of the afore mentioned embodiments, wherein one or more of the charges, preferably each of the charges, is selected from the group consisting of: a stopper, a plunger and a seal.

The device according to one or more of the afore mentioned embodiments, wherein one or more of the charges, preferably each of the charges, comprises a material having a Young's modulus less than that of the corresponding elongate receptacle.

The device according to one or more of the afore mentioned embodiments, wherein one or more of the charges, preferably each of the charges, comprises a thermoplastic elastomer. The thermoplastic elastomer preferably comprises a butyl group or a halogen or both. Preferred halogens in this context are fluorine, chlorine and bromine.

The device according to one or more of the afore mentioned embodiments, wherein one or more of the elongate receptacles, preferably each of the elongate receptacles, comprises a polymer, preferably is made of a polymer. A preferred polymer is a cycloolefin copolymer or a cycloolefin polymer.

The device according to one or more of the afore mentioned embodiments, wherein one or more of the elongate receptacles, preferably each of the elongate receptacles, comprises a glass, preferably is made of a glass. A preferred glass in this context comprises one or more selected from the group consisting of: silicon, boron and aluminum. One preferred glass comprises boron and silicon. One preferred glass is a borosilicate glass. One preferred glass comprises aluminum and silicon. One preferred glass is an aluminosilicate glass.

The device according to one or more of the afore mentioned embodiments, wherein one or more of the elongate receptacles, preferably each of the elongate receptacles, has a superior aperture. The superior aperture is preferably open.

The device according to one or more of the afore mentioned embodiments, further comprising a superior part, the superior part comprising the superior surface, and an inferior part, wherein the inferior part is slidably engageable with the superior part. In one aspect of this embodiment, the device is adapted and arranged to function with the inferior part located below the superior part. In one aspect of this embodiment, the slidable engagement between the superior part and the inferior part is adapted and arranged to allow relative movement between the inferior part and the superior part in a direction normal to the superior surface.

The device according to one or more of the afore mentioned embodiments, wherein either: the device has one or more pusher and the slidable engagement is adapted and arranged to allow movement relative to the superior surface of one or more of the pusher, preferably each of the pusher, or the device has one or more second positioning device and the slidable engagement is adapted and arranged to allow movement relative to the superior surface of one or more of the second positioning device, preferably each of the second positioning device, The device according to one or more of the afore mentioned embodiments, wherein the detaining device limits the extent of a sliding movement of the inferior part towards the superior part.

The device according to one or more of the afore mentioned embodiments, wherein the detaining device is an abutment between the superior part and the inferior part.

The device according to one or more of the afore mentioned embodiments, wherein the device has one or more pusher and the detaining device is an abutment limiting the extent of movement towards the superior surface of one or more of the pushers, preferably each of the pusher.

The device according to one or more of the afore mentioned embodiments, wherein the detaining device is one or more second positioning device. In one aspect of this embodiment, the one or more second positioning device are an abutment which limits the extend of movement of the one or more pusher towards the superior surface.

The device according to one or more of the afore mentioned embodiments, wherein the device comprises one or more second positioning device and one or more of the second positioning device are holes in an inferior surface. The device is preferably adapted and arrange to operate with the inferior surface below the superior surface. The inferior surface preferably has one or more holes for locating the pusher.

The device according to one or more of the afore mentioned embodiments, wherein the detaining device is an inferior surface.

The device according to one or more of the afore mentioned embodiments, wherein one or more of the first positioning device, preferably each of the first positioning device, has an inferior abutment adapted and arranged to support an elongate receptacle from below.

The device according to one or more of the afore mentioned embodiments, wherein one or more of the first positioning device, preferably each of the first positioning device, has a superior abutment adapted and arranged to limit the extent of a movement of the corresponding elongate receptacle towards the superior surface.

The device according to one or more of the afore mentioned embodiments, wherein one or more of the first positioning device, preferably each of the first positioning device, has a retainer, wherein the retainer is adapted and arranged to retain an accommodated elongate receptacle to prevent movement when a force below a threshold value is applied to the elongate receptacle in a direction normal to the superior surface and releases the elongate receptacle to allow movement when a force above the threshold value is applied to the elongate receptacle in a direction normal to the superior surface. A preferred retainer is a resilient member.

The device according to one or more of the afore mentioned embodiments, wherein the device is adapted and adjusted to accommodate 3 or more pairings of charge and elongate receptacle, preferably 10 or more, more preferably 20 or more, more preferably 50 or more.

The device according to one or more of the afore mentioned embodiments, wherein the first positioning device are held in a fixed position relative to each other.

The device according to one or more of the afore mentioned embodiments, wherein the first positioning device are arranged in an array.

The device according to one or more of the afore mentioned embodiments, wherein the first positioning device are adapted and arranged to accommodate elongate receptacle such that at least a pair, preferably all of the elongate receptacles, have parallel axes defined by their elongate extensions.

The device according to one or more of the afore mentioned embodiments, wherein the closest distance between a first first positioning device and a second first positioning device is in the range from 3 to 8 mm, preferably in the range from 4 to 7 mm, more preferably in the range from 5 to 6 mm.

The device according to one or more of the afore mentioned embodiments, wherein the closest distance between a first first positioning device and a second first positioning device is not more than 8 mm, preferably not more than 7 mm, more preferably not more than 6 mm The device according to one or more of the afore mentioned embodiments, wherein the closest distance between a first first positioning device and a second first positioning device is not less than 3 mm, preferably not less than 4 mm, more preferably not less than 5 mm.

The device according to one or more of the afore mentioned embodiments, wherein one or more of the pushers, preferably each of the pusher, comprises, preferably is, an elongate rod.

The device according to one or more of the afore mentioned embodiments, wherein the superior surface comprises a polymer.

The device according to one or more of the afore mentioned embodiments, wherein the polymer is one or more selected from the group consisting of: polypropylene, polyethylene, polyamide, polyoxymethylene, polyvinylchloride, thermoplastic polyurethane, thermoplastic elastomer, liquid silicone rubber and polylactate.

The device according to one or more of the afore mentioned embodiments, wherein the device is located inside a sterile container. Preferred containers are tubs, boxes, pouches and bags, or a combination of two or more thereof.

The present application also provides a process for producing a filled elongate receptacle. The process includes the steps of: providing a device having a pairing of an elongate receptacle and a charge accommodated in a first positioning device; pushing the charge into the elongate receptacle, preferably from below, preferably to close an inferior aperture of the elongate receptacle; and introducing an amount of liquid pharmaceutical composition into the elongate receptacle from above via the superior aperture to obtain a filled volume in the elongate receptacle.

The method according to one or more of the afore mentioned embodiments, wherein the providing the device includes providing the device with a plurality of receptacles and further includes filling the plurality of elongate receptacles.

A process for producing a filled elongate receptacle is also provided that includes the steps: providing an elongate receptacle, the elongate receptacle having an inferior aperture and a superior aperture; pushing a charge into the elongate receptacle from below, preferably to close the inferior aperture; and introducing an amount of liquid pharmaceutical composition into the elongate receptacle from above via the superior aperture to obtain a filled volume in the elongate receptacle.

The method according to one or more of the afore mentioned embodiments, wherein the process further includes closing the superior aperture of the elongate receptacle.

The method according to one or more of the afore mentioned embodiments, wherein the elongate receptacle is not rotated more than 30°, preferably not more than 20°, more preferably not more than 10°.

The method according to one or more of the afore mentioned embodiments, wherein the elongate receptacle is located in and remains in a first positioning device until the introducing step.

The method according to one or more of the afore mentioned embodiments, wherein a pressure inside the elongate receptacle prior to step b. is at least 104 Pa, preferably at least 5·104 Pa, preferably at least 9·104 Pa. In one aspect of this embodiment, the process is performed at atmospheric pressure. In one aspect of this embodiment, the process is performed above atmospheric pressure. In one aspect of this embodiment, the process is performed at around 105 Pa. In one aspect of this embodiment, the process is performed at over 105 Pa.

The method according to one or more of the afore mentioned embodiments, wherein a pressure inside the elongate receptacle prior to step b. is less than 105 Pa, preferably less than 104 Pa, more preferably less than 103 Pa, most preferably less than 5·102 Pa. In one aspect of this embodiment, the process is performed inside a vacuum housing.

The method according to one or more of the afore mentioned embodiments, wherein a plurality of filled elongate receptacles is produced by the process steps; wherein the filled elongate receptacles have a set of elongate receptacle lengths {L} having a mean value LM and a standard deviation LSD and a set of product fill heights { F} having a mean value FM and a standard deviation FSD; wherein the following is satisfied: (LSD·FM)/(LM·FSD)>0.15; preferably (LSD·FM)/(LM·FSD)>0.25; more preferably (LSD·FM)/(LM·FSD)>0.40; most preferably (LSD·FM)/(LM·FSD)>0.60; most preferably (LSD·FM)/(LM·FSD)>0.80; most preferably (LSD·FM)/(LM·FSD)>1.0; most preferably (LSD·FM)/(LM·FSD)>1.5.

In a further aspect of this embodiment, the following is satisfied: (LSD·FM)/(LM·FSD)>1; preferably (LSD·FM)/(LM·FSD)>2; more preferably (LSD·FM)/(LM·FSD)>3; most preferably (LSD·FM)/(LM·FSD)>4; most preferably (LSD·FM)/(LM·FSD)>5; most preferably (LSD·FM)/(LM·FSD)>10; most preferably (LSD·FM)/(LM·FSD)>12.

A plurality of filled elongate receptacles are provided, wherein the filled elongate receptacles have a set of elongate receptacle lengths {L} having a mean value LM and a standard deviation LSD and a set of product fill heights { F} having a mean value FM and a standard deviation FSD;

wherein the following is satisfied: (LSD·FM)/(LM·FSD)>0.15; preferably (LSD·FM)/(LM·FSD)>0.25; more preferably (LSD·FM)/(LM·FSD)>0.40; most preferably (LSD·FM)/(LM·FSD)>0.60; most preferably (LSD·FM)/(LM·FSD)>0.80; most preferably (LSD·FM)/(LM·FSD)>1.0; most preferably (LSD·FM)/(LM·FSD)>1.5.

In a further aspect of this embodiment, the following is satisfied: (LSD·FM)/(LM·FSD)>1; preferably (LSD·FM)/(LM·FSD)>2; more preferably (LSD·FM)/(LM·FSD)>3; most preferably (LSD·FM)/(LM·FSD)>4; most preferably (LSD·FM)/(LM·FSD)>5; most preferably (LSD·FM)/(LM·FSD)>10; most preferably (LSD·FM)/(LM·FSD)>12.

BRIEF DESCRIPTION OF THE DRAWINGS

The invention is exemplified by means of not limiting figures.

DETAILED DESCRIPTION

Figure 1:
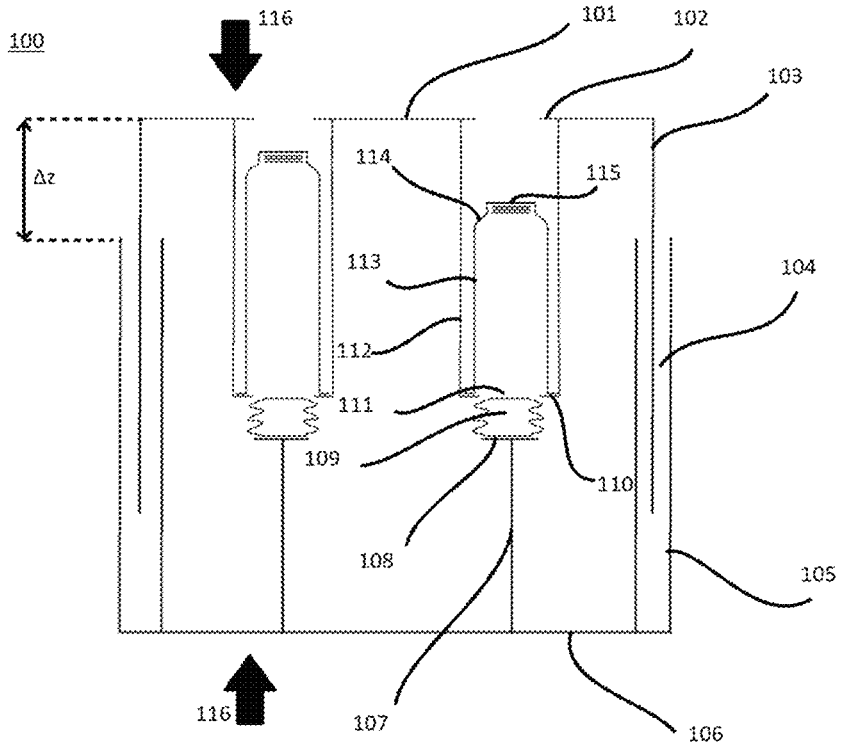
FIG. 1 shows a device according to the invention having superior and inferior parts.

The term "parallel" throughout this disclosure preferably means at an angle of not more than 20° to, preferably not more than 5°, more preferably not more than 3°.

Atmospheric pressure is taken in this document to be 101325 Pa.

This disclosure refers in various places to one or more, in connection with first positioning device, elongate receptacles, charges, pusher, second positioning device and other parts of the device. In each case, it is preferred for there to be at least 10, preferably at least 20, more preferably at least 50.

Superior Surface and Directions. The device according to the invention comprises a superior surface. The superior surface provides a reference against which to define concepts of vertical, up, down, horizontal etc.

The superior surface is preferably planar.

An axis normal to the superior surface may be defined as vertical. A direction perpendicular to vertical is horizontal.

Movement of an object in a direction towards the superior surface is generally a movement which reduces the shortest distance between the object and the superior surface.

The device is preferably adapted and arranged to be operated with a normal to the superior surface parallel to the force of gravity.

The superior surface is preferably adapted and arranged to function with the superior surface above one or more other parts of the device. Equivalently, the sense of the vertically up direction may be defined in that the superior surface is above one or more other constituents of the device.

Device. A contribution to at least partially achieving one or more of the above-mentioned objects is made by a device disclosed herein. A preferred device is adapted and arranged for introducing one or more charges into one or more corresponding elongate receptacles, preferably from below. The device either has one or more pusher for introducing one or more charges into corresponding elongate receptacles or one or more second positioning device for accommodating one or more pusher for introducing one or more charges into corresponding elongate receptacles.

In one embodiment, a multi-part embodiment, the device comprises a superior part and an inferior part which are movable relative to each other. Preferably, at least part of the superior part is above at least part of the inferior part. Preferred relative movement of the superior and inferior parts moves the parts towards or away from each other. A preferred relative movement is in a direction normal to the superior surface. The superior part preferably comprises the superior surface. The inferior part may comprise an inferior surface. A preferred relative movement changes the distance between the superior surface and the inferior surface.

In a multi-part device, the superior part and the inferior part are preferably slidably engaged or slidably engageable. The slidable engagement may comprise the detaining device, which preferably limits the extent of sliding movement.

In a multi-part device, the device may comprise pusher or second positioning device or both. The pushing function of the pusher is preferably constituted by relative movement of the superior and inferior parts. The pusher preferably moves with the inferior part. The second positioning device preferably moves with the inferior part.

In a multi-part device, the detaining device may limit relative movement of the superior and inferior parts. Preferably, the detaining device limits the closest approach of the superior surface and an inferior surface.

In an alternative embodiment, the device has an integral part comprising the superior surface and one or more second positioning device. A pushing function is preferably constituted by introduction of pusher at the second positioning device.

First Positioning device. The device comprises one or more first positioning device. A preferred first positioning device is adapted and arranged to accommodate a pairing of an elongate receptacle and a charge. The accommodation of the pairing is preferably adapted and arranged such that the charge can be introduced into the elongate receptacle by a pusher.

A first positioning device may be adapted and arranged for supporting the elongate receptacle from below. The first positioning device may complement the elongate receptacle such that the elongate receptacle can rest on the first positioning device.

A first positioning device may be adapted and arranged for limiting upward movement of the elongate receptacle. The first positioning device may complement the elongate receptacle such that the elongate receptacle's upward movement is limited by abutment with the first positioning device.

A first positioning device may be adapted and arranged to allow vertical movement of the elongate receptacle or charge or both.

A first positioning device may be adapted and arranged to restrict horizontal movement of the elongate receptacle or charge or both.

A first positioning device may have a retainer with a threshold resistance. The retainer prevents movement of the elongate receptacle for a force on the elongate receptacle below the threshold resistance. The retainer allows movement of the elongate receptacle for a force on the elongate receptacle above the threshold resistance. The threshold resistance is preferably greater than a force required to move the charge inside the elongate receptacle. The threshold resistance is preferably greater than a frictional force between the charge and the inside of the elongate receptacle. The retainer is preferably adapted and arranged to allow the elongate receptacle to be removed from the device by applying a force above the threshold force. Forces in this embodiment are preferably along an axis defined by the elongate extension of the elongate receptacle.

In one embodiment, the charge is positioned outside the elongate receptacle. The charge is preferably positioned close to an inferior end of the elongate receptacle. The charge is preferably positioned close to an inferior aperture of the elongate receptacle. The charge is preferably positioned below the elongate receptacle. The charge is preferably positioned along an axis defined by the elongate extension of the elongate receptacle.

In another embodiment, the charge is positioned at least partially inside the elongate receptacle. In one aspect of this embodiment, the charge is fully contained by the elongate receptacle. In this aspect, the charge is preferably close to an inferior end of the elongate receptacle. In this aspect, the charge is preferably close to an inferior aperture of the elongate receptacle. In another aspect of this embodiment, the charge is partially contained by the elongate receptacle.

In this aspect, the charge is preferably positioned in an inferior aperture of the elongate receptacle. In this aspect, the charge is preferably positioned at an inferior end of the elongate receptacle.

A first positioning device may be adapted and arranged to accommodate an elongate receptacle such that the axis defined by the elongate extension of the elongate receptacle is vertical.

Charge. The device is adapted and arranged to accommodate one or more charges. In one embodiment, the device comprises one or more charges. A preferred charge is adapted and arranged to close an aperture of an elongate receptacle, preferably an inferior aperture.

A preferred charge is made of an elastic material or comprises a part made of an elastic material. The charge is preferably adapted and arranged to seal an aperture of the elongate receptacle, preferably an inferior aperture. The charge is preferably adapted and arranged to move inside the elongate receptacle, preferably along the axis defined by the elongate extension of the elongate receptacle. When inside the elongate receptacle, movement of the charge is preferably resisted by a frictional force between the charge and an inside surface of the elongate receptacle.

A charge may be a stopper. A preferred stopper seals an aperture of the elongate receptacle, preferably an inferior aperture.

A charge may be a plunger. A preferred plunger provides a seal which can be moved along the axis defined by the elongate extension of the elongate receptacle, preferably to expel liquid from the elongate receptacle.

Elongate receptacle. The device is adapted and arranged to accommodate one or more elongate receptacles. In one embodiment, the device comprises one or more elongate receptacles. A preferred elongate receptacle is adapted and arranged to contain a pharmaceutical liquid.

A preferred elongate receptacle has two ends, a superior end and an inferior end, preferably with the inferior end below the superior end during normal operation of the device. A preferred elongate receptacle has an inferior aperture, preferably at an inferior end. A preferred elongate receptacle has a superior aperture, preferably at a superior end.

The elongate receptacle is preferably hollow, having an interior and at least one side wall. Preferred shapes for the elongate receptacle are a hollow cylinder and a hollow prism.

A preferred elongate receptacle has an elongate extension in the range from 0.01 to 0.5 m, preferably in the range from 0.02 to 0.3 m, more preferably in the range from 0.03 to 0.2 m, most preferably in the range from 0.04 to 0.1 m.

A preferred elongate receptacle has an internal volume in the range from 0.05 to 100 ml, preferably in the range from 0.1 to 80 ml, more preferably in the range from 0.2 to 60 ml, most preferably in the range from 0.3 to 40 ml, most preferably in the range from 0.4 to 20 ml, most preferably in the range from 0.5 to 10 ml.

A preferred elongate receptacle has a side-wall thickness in the range from 0.0008 to 0.003 m, preferably in the range from 0.001 to 0.0025 m, more preferably in the range from 0.0012 to 0.002 m.

A preferred elongate receptacle has an internal diameter in the range from 0.004 to 0.05 m, preferably in the range from 0.005 to 0.04 m, more preferably in the range from 0.006 to 0.03 m.

A preferred elongate receptacle comprises a lubricant layer, preferably in an interior, more preferably on an interior surface of a side wall. A preferred lubricant comprises a silicone oil. A preferred lubricant layer is adapted and arranged to facilitate movement of a charge within the elongate receptacle.

Detaining device. The device comprises a detaining device. A preferred detaining device limits an extent of movement, preferably limits an extent of intrusion of one or more charges into corresponding elongate receptacles.

In an embodiment in which the device comprises one or more pusher, the detaining device preferably limits an extent of movement of the pusher towards the superior surface. In an embodiment in which the device comprises one or more second positioning device, the detaining device preferably limits an extent of movement of the second positioning device towards the superior surface.

In one embodiment, the detaining device limits an extent of movement of an inferior part with respect to a superior part, the superior part comprising the superior surface. In this embodiment, either one or more pusher or one or more second positioning device is fixed relative to the inferior part and the limitation of the extent of movement between the inferior part and the superior part is also a limitation of the extent of movement of the pusher or second positioning device towards the superior surface. One preferred detaining device in this context is an abutment between the superior part and the inferior part. Another preferred detaining device in this context is incorporated into a slidable engagement, preferably an abutment incorporated into the slidable engagement.

In one embodiment, the detaining device limits an extent of movement of an inferior surface with respect to the superior surface. In this embodiment, either one or more pusher or one or more second positioning device is fixed relative to the inferior surface and the limitation of the extent of movement between the inferior surface and the superior surface is also a limitation of the extent of movement of the pusher or second positioning device towards the superior surface. In one aspect of this embodiment, a preferred second positioning device is a hole in the inferior surface. One preferred detaining device in this context is an abutment between the superior part and the inferior part. Another preferred detaining device in this context is incorporated into a slidable engagement, preferably an abutment incorporated into the slidable engagement.

In one embodiment, the detaining device is an abutment for a pusher. In a preferred aspect of this embodiment, the device comprises one or more holes in an inferior surface. The holes act as second positioning device, allowing one or more pusher to be introduced into the device via the holes. The detaining device is constituted by abutment of the pusher against the inferior surface from below to limit the extent to which the pusher can be introduced through the holes into the device.

Pusher. The device either comprises one or more pusher or comprises one or more second positioning device adapted and arranged to accommodate one or more pusher. A preferred pusher is adapted and arranged to introduce a charge into an elongate receptacle.

A preferred pusher is an elongate rod. A rod may have a cap at an end to spread a force applied to a charge.

In the case where a pusher is included in the device, it is preferably integrated into the device, preferably into an inferior part, preferably an inferior surface.

In the case where a second positioning device is included in the device, it is preferably integrated into the device, preferably into an inferior part, preferably an inferior surface. A pusher is provided externally during operation of the device to be positioned by the second positioning device.

Arrangements. The device is adapted and arranged to accommodate one or more pairings of elongate receptacle and charge. It is preferred for the device to accommodate 3 or more, preferably 10 or more, more preferably 20 or more, most preferably 50 or more pairings.

There are preferably one or more correspondences between first positioning device, the pusher, and the second positioning device. In one embodiment, each first positioning device is adapted and arranged to accommodate a single pairing of elongate receptacle and charge. In one embodiment, each first positioning device corresponds with a pusher. In one embodiment, each first positioning device corresponds with a second positioning device. In one embodiment, each second positioning device is adapted and arranged to accommodate a single pusher.

The first positioning device may be arranged in a pattern. The first positioning device may be arranged in an array. The second positioning device may be arranged in a pattern. The second positioning device may be arranged in an array. The pusher may be arranged in a pattern. The pusher may be arranged in an array.

The first positioning device maybe adapted and arranged to position the elongate receptacles such that at least a pair of the elongate receptacles, preferably all of the elongate receptacles, have parallel axes. The axis of an elongate receptacle is defined by the direction of its elongate extension.

Process. A contribution to at least partially achieving one or more of the above-mentioned objects is made by a process for producing a filled elongate receptacle. The process preferably comprises a step of pushing a charge into the elongate receptacle, preferably from below, preferably via an inferior aperture, and a step of introducing a liquid pharmaceutical into the elongate receptacle, preferably from above, preferably via a superior aperture. The process may also comprise a further step of closing a further aperture of the elongate receptacle.

The process may be performed using a device according to this disclosure.

In a preferred process, an inferior aperture of the elongate receptacle is closed from below. The elongate receptacle is preferably then filled from above. A superior aperture of the elongate receptacle may then be closed from above.

In a preferred process, the elongate receptacle close from below.

In a preferred process, the elongate receptacle is filled from above.

In a preferred process, the elongate receptacle remains in position between closing an inferior aperture and filling. In one aspect of this embodiment, the axis of the elongate receptacle, defined by the direction of its elongate extension, is not rotated more than 90° with respect to the direction of the gravitation force, preferably not more than 30°, more preferably not more than 10°, most preferably not more than 5°. In one aspect of this embodiment, the elongate receptacle remains accommodated by the first positioning device during and between the closing of an inferior aperture and filling.

The process may include closing a superior aperture of the elongate receptacle.

The process of the invention can be performed to produce a plurality of filled elongate receptacles. The plurality is preferably produced simultaneously. Preferably, a charge is introduced into each of the plurality of elongate receptacles before any of the elongate receptacles are filled. The introduction of the charges into the plurality of elongate receptacles is preferably simultaneous. Preferably, the elongate receptacles are filled simultaneously.

In one embodiment, the charge is initially outside the elongate receptacle. In this case, the charge preferably closes an inferior aperture of the elongate receptacle during the process. In an alternative embodiment, the charge is initially already at least partially inside the elongate receptacle. In this case, the pushing moves the charge further upwards in the elongate receptacle.

In a preferred process, charges are pushed into elongate receptacles prior to introduction of liquid pharmaceutical material.

Liquid Pharmaceutical Composition. A contribution to at least partially achieving one or more of the above-mentioned objects is made by a process in which a liquid pharmaceutical composition is introduced into an elongate receptacle or a filled elongate receptacle containing a liquid pharmaceutical composition.

A liquid pharmaceutical composition preferably comprises an active compound. A liquid pharmaceutical composition is a fluid.

A preferred amount of liquid pharmaceutical composition is in the range from 0.05 to 100 ml, preferably in the range from 0.1 to 80 ml, more preferably in the range from 0.2 to 60 ml, most preferably in the range from 0.3 to 40 ml, most preferably in the range from 0.4 to 20 ml, most preferably in the range from 0.5 to 10 ml.

In one embodiment of the process, liquid pharmaceutical composition is filled into the elongate receptacle up to a reference line, preferably with a laser detector adapted and arranged to detect at the reference line.

Calibration. The device of the invention can usefully be employed for simplifying a stoppering process and for improving uniformity of available fill height, product fill height and dosage. Fill heights and dosage can be controlled by modifying the extent to which pusher push charges into elongate receptacles.

In a first embodiment of the invention, in which the device has a superior part and an inferior part, fill heights and dosage can be calibrated by altering the abutment between the superior and inferior parts. Alternatively, fill heights and dosage can be calibrated by setting an extent of movement of a slidable engagement.

In a second embodiment of the invention, in which pusher are introduced into the device via second positioning device, fill heights and dosage can be calibrated by altering length of external pusher. Alternatively, fill heights and dosage can be calibrated by setting a position of an inferior surface.

Assembly. One aspect of this disclosure relates to an assembly comprising: a device according to this disclosure, and one or more pusher.

In one embodiment of the assembly, the device comprises one or more pusher. In one aspect of this embodiment, the pusher is preferably inside the device. In one aspect of this embodiment, the assembly preferably is the device.

In another embodiment of the assembly, the assembly comprises one or more pusher in addition to the device. In one aspect of this embodiment, the pusher is preferably outside the device. In this aspect of this embodiment, the assembly is preferably adapted and arranged such that the pusher can enter into the device, preferably through one or more second positioning device. In one aspect of this embodiment, the one or more pushers preferably complement one or more second positioning device of the device. In one aspect of this embodiment, the one or more pusher are preferably adapted and arranged to be accommodated by one or more second positioning device of the device such that the pusher are each moveable along a direction towards the superior surface to introduce an accommodated charge into a corresponding elongate receptacle, wherein the detaining device limits the extent of movement of the pusher towards the superior surface. In one aspect of this embodiment, the one or more pusher may be provided as an instalment in a factory line. In one aspect of this embodiment, the assembly comprising the device and the pusher preferably functions analogously to a device which itself comprises one or more pusher.

A device comprising one or more second positioning device is preferably adapted and arranged to cooperate with one or more pusher as constituents of an assembly, preferably so as to operate analogously to a device which itself comprising one or more pusher.

Preferred embodiments of the device described in this document are also preferred embodiments for the device constituent of the assembly.

FIG. 1 shows a device 100 according to the invention having a superior part 103 and an inferior part 105. The superior part 103 comprises the superior surface 101, which defines a horizontal plane. The superior surface 101 is above the other parts of the device 100. The inferior part 105 comprises an inferior surface 106, which is parallel to the superior surface and is below the other parts of the device 100. The superior part 103 and the inferior part 105 are slidably engageable at a slidable engagement 104. Two elongate receptacles 113 are shown in position in the device 100. In some embodiments, the elongate receptacles 113 are not present in the device 100, but the device 100 is adapted and arranged for their accommodation. The elongate receptacles 113 are position with their direction of elongation normal to the superior surface 101. The elongate receptacles 113 are held in positioning by a positioning device 112, which holds their axis of elongate extension normal to the superior surface and allows them to move vertically towards or away from the superior surface 101. The positioning device 112 provides an inferior abutment 110, which limits the extent of downward movement of the elongate receptacle 113 (away from the superior surface 101). The elongate receptacle 113 is shown resting on the inferior abutment 110. The superior surface 101 complements the elongate receptacle 113, providing a superior abutment 102 against which superior shoulders 114 of the elongate receptacle 113 can abut, thus limiting the extent of upward movement of the elongate receptacle 113 (towards the superior surface 101). The elongate receptacle in this case has a superior aperture 115, through which the elongate receptacle 113 can be filled subsequently to closure of the inferior aperture 111 with the charge 109. The superior aperture 115 in this case has a screw thread for closure. A charge 109, in this case an elastic cylindrical plunger having ribbed sides, is positioned below the elongate receptacle 113 at an inferior aperture 111 of the elongate receptacle 113. The charge 109 in this case rests on a pusher 107 located below the charge 109. The pusher 107 is an elongate rod having a cap 108 at its superior end, which distributes a pushing force at the contact with the charge 109. In operation, a vertical compressive force 116 can be applied to urge the superior part 103 and the inferior part 105 towards each other. This movement is facilitated and guided by the slidable engagement 104. An extent of movement $\Delta z$ of the inferior surface 106 towards the superior surface 101 can be performed before abutment between the inferior part 105 and the superior part 103. In this case, the abutment is integrated into the slidable engagement 104. The device 100 already comprises pusher 107 and the contents of FIG. 1 can therefore be considered to constitute an assembly as described herein.

Figure 2:
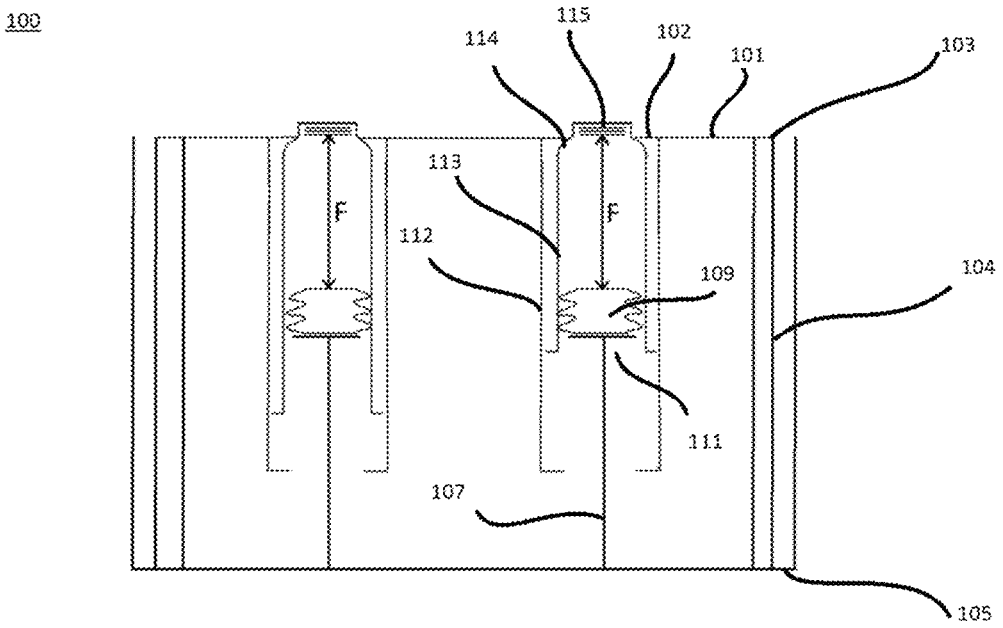
FIG. 2 shows the device of FIG. 1 following pushing of charges into elongate receptacles by application of a compressive force.

FIG. 2 shows the device 100 of FIG. 1 after a compressive force 116 has been applied to push the superior part 103 and the inferior part 105 towards each other. During movement the compressive movement, the pusher 107, which are incorporated into the inferior part 105 have moved towards the superior surface 101 and have pushed the charges 109 towards the superior surface 101. At the start of the movement, the elongate receptacles 113 were pushed upwards towards the superior surface 101, but then abutted with their superior shoulders 114 against the superior abutment 102 of the superior surface 101. The charges 109, which continued to move upwards after the abutment between the elongate receptacles 113 and the superior surface 101, were driven inside the elongate receptacles 113 via their inferior apertures 111. The movement stopped once the inferior part 105 abutted with the superior part 103. At the end of the movement, shown in FIG. 2, the elongate receptacles 113 have the same available fill height F between the top of the charge and the superior aperture 115 of the elongate receptacle 113. This is because the charges 109 have been pushed to the same height and the tops of the elongate receptacles 113 are abutted in a line with the superior surface 101. The constant available fill height F in the elongate receptacles 113 is despite different lengths of the elongate receptacles 113, as shown in FIG. 2. In an alternative arrangement, the superior abutments 102 in the superior surface 101 are not present. The extent of upward movement of the elongate receptacles 113 is achieved rather by applying the downward component of the compressive force by a horizontal member which abuts with the top of each elongate receptacle 113 to again align their superior ends.

Figure 3:
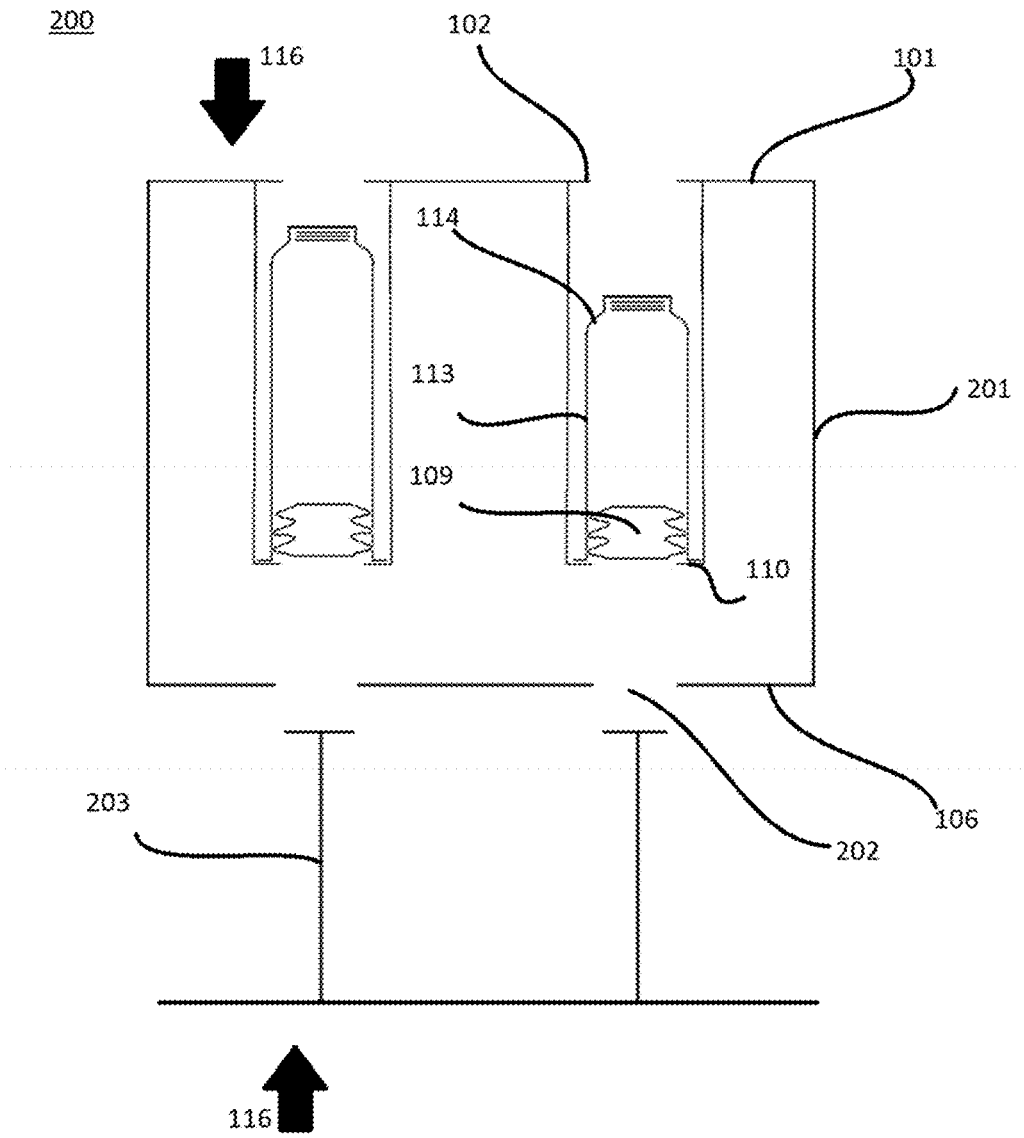
FIG. 3 shows an integral device according to the invention along with external pusher.

FIG. 3 shows an integral device 200 according to the invention. The device 200 has an integrated part 201 which comprises both the superior surface 101 and the inferior surface 106, which are held in position relative to each other. The device 200 does not have pusher, rather it has second positioning device 202, which are in the form of holes in the inferior surface 106. The second positioning device are adapted and arranged to allow external pusher 203 to be introduced into the device 200 from below. As in FIG. 1, the elongate receptacles 113 rest on an inferior abutment 110 and superior abutments 102 are provided for the shoulders 114 of the elongate receptacle to limit the extent of upward movement of the elongate receptacle 113. In this case, the charges 109 are present inside the elongate receptacles 113 at their inferior ends. the charges 109 could alternatively be positioned partially inside the elongate receptacles 113 or even outside the elongate receptacles 113. Even though the charges 109 are already present inside the elongate receptacles 113, they will be pushed further into the elongate receptacle 113 by the external pusher 203 during operation of the device 200.

On application of a compressive force 116, the external pusher 203 will enter the device 200 via the second positioning device 202 to make contact with and drive the charges 109 into the elongate receptacles 113 until such point as the external pusher 203 abut with the inferior surface 106. FIG. 3 depicts the device 100 along with the external pusher 203 and can therefore be considered to constitute an assembly as described herein.

Figure 4:
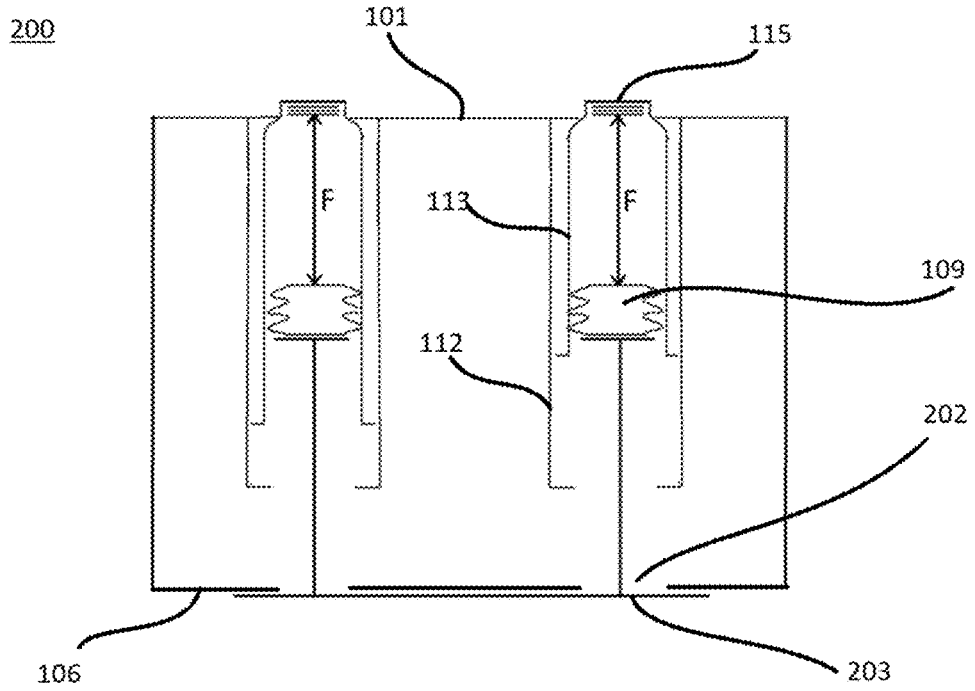
FIG. 4 shows the device of FIG. 3 following introduction of external pusher and pushing of charges into elongate receptacles by application of a compressive force.

FIG. 4 shows the device 200 of FIG. 3 after action of the compressive force. The external pusher 203 have entered the device 200 via the second positioning device 202. The external pusher 203 have made contact with the charges 109 from below and driven the charges 109 with their respective elongate receptacles 113 upwards until the elongate receptacles 113 abutted against the superior surface 101. Thereupon, the external pusher 203 continued to intrude into the device 200, driving the charges 109 into the elongate receptacles 113 until the external pusher 203 came into abutment with the inferior surface 106, whereupon the movement stopped. At the end of the movement, shown in FIG. 4, the elongate receptacles 113 have the same available fill height F between the top of the charge and the superior aperture 115 of the elongate receptacle 113. This is because the charges 109 have been pushed to the same height and the tops of the elongate receptacles 113 are abutted in a line with the superior surface 101. The constant available fill height F in the elongate receptacles 113 is despite different lengths of the elongate receptacles 113, as shown.

Figure 5:
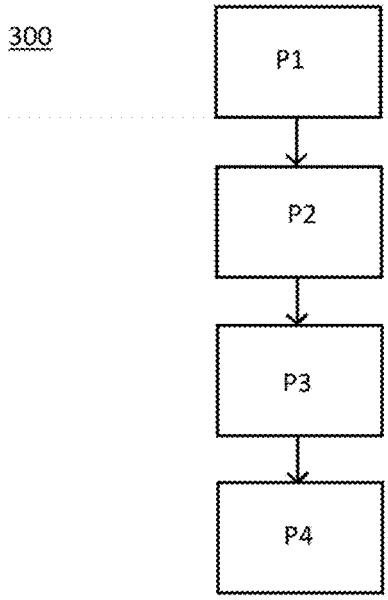
FIG. 5 shows a schematic representation of a process according to the invention.

FIG. 5 shows a process 300 according to the invention. In a first step P1, an elongate receptacle 113 having a superior aperture 115 and an inferior aperture 111. In a second step P2, a charge 109 is introduced into the elongate receptacle 113 from below to close its inferior aperture 111. In a third step, a liquid pharmaceutical composition is introduced into the elongate receptacle 113 from above via its superior aperture 115. In a fourth step P4, the superior aperture 115 is closed.

Figure 6:
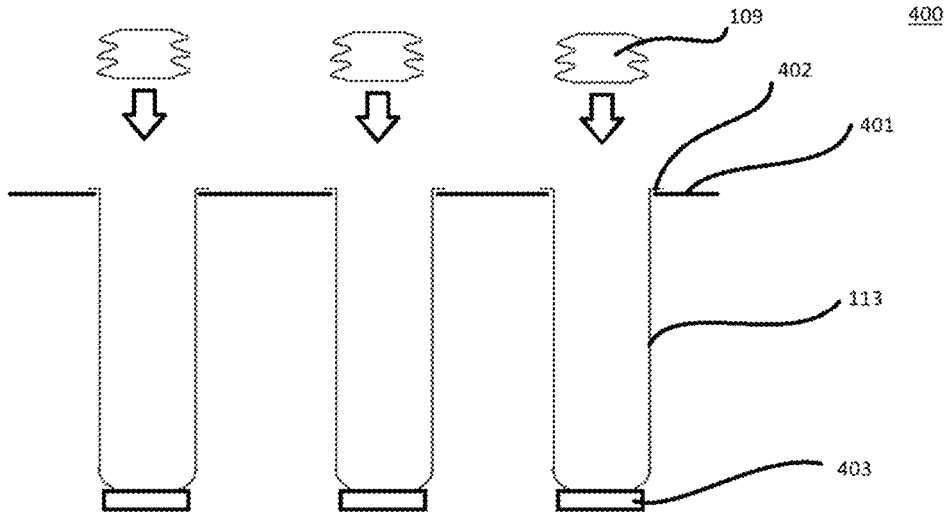
FIG. 6 shows a prior art arrangement for stoppering from above.

FIG. 6 shows a prior art arrangement 400 for stoppering from above. Elongate receptacles 113 are positioning in a nest 401, supported by abutment of an outwardly protruding flange 402 with the upper surface of the nest 401. The elongate receptacles 113 have an open aperture directed upwards and at their lower end are pre-closed with a screw cap 403. To produce a filled elongate receptacle 113, a liquid is introduced via the opening at the top and charges 109 are introduced into the open aperture of the elongate receptacle 113 from above. Introduction of the charges 109 is performed at reduced pressure.

Figure 7:
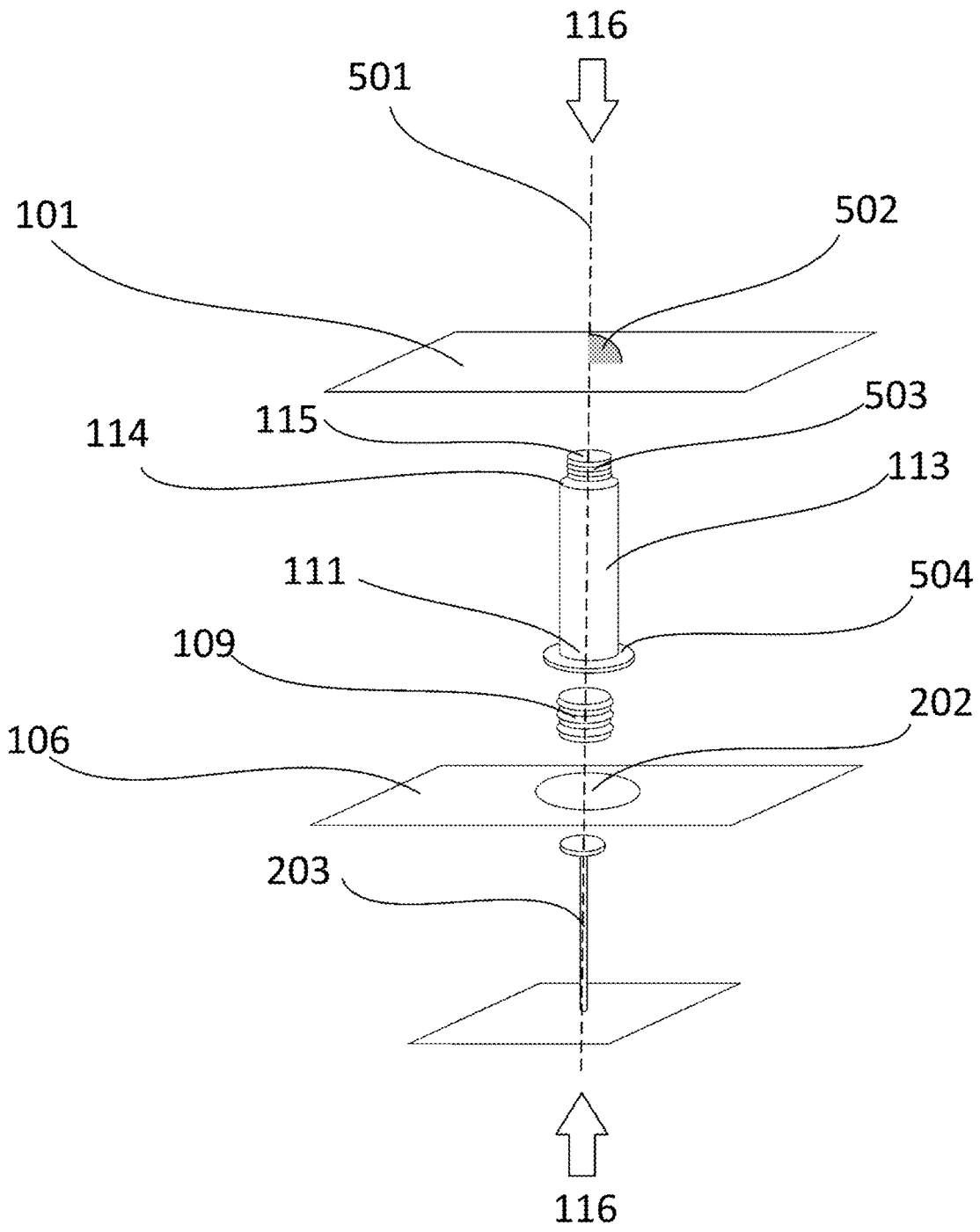
FIG. 7 shows positioning of various parts of the device relative to an axis.

FIG. 7 shows positioning of various parts of the device 100 relative to an axis 501. An axis 501 is shown which is normal to the superior surface 101. The angle 502 between the axis and the surface is thus 90°. Below the superior surface 101 is an elongate receptacle 113, the elongate receptacle 113 having its axis of elongation coincident with the axis 502 normal to the superior surface 101. The elongate receptacle 113 is orientated with a screw thread 503 at its superior aperture 115. A screw attachment can be attached to the screw thread 503. At the inferior aperture 111 of the elongate receptacle 113, the elongate receptacle has an outwards projecting flange 504, which can usefully be employed for resting the elongate receptacle 113 on a surface of a first positioning device 112 (not shown). The charge 109 is positioned on the axis 501, below the elongate receptacle 113, close to the inferior aperture 111. An inferior surface 106 is shown, in which a second positioning device 202 is present in the form of a hole in the inferior surface 106. Below the inferior surface 106 is shown, in this case, an external pusher 203. In operation, a compressive force 1106 is applied downwards to the superior surface 101 and upwards to the external pusher 203. The compressive force 116 is applied in a direction parallel to the axis 501. The compressive force 116 causes the external pusher 203 to enter the device 100 via the second positioning device 202. The external pusher 203 will then pushing the charge 109 upwards along the axis 501 into the elongate receptacle via the inferior aperture 111. Movement terminates when the base of the external pusher 203 abuts against the underside of the inferior surface 106, which is acting as a detaining device. A first positioning device 112 is not shown. Also not shown here is the device to limit the extent of upward movement of the elongate receptacle 113. One alternative is for the upper component of the compressive force 116 to applied via a horizontal plane which acts and abutment. Another alternative is for a complementary abutment to the superior shoulder 114 of the elongate receptacle to be provided, either in a first positioning device 112 or in the superior surface 101.

Figure 8:
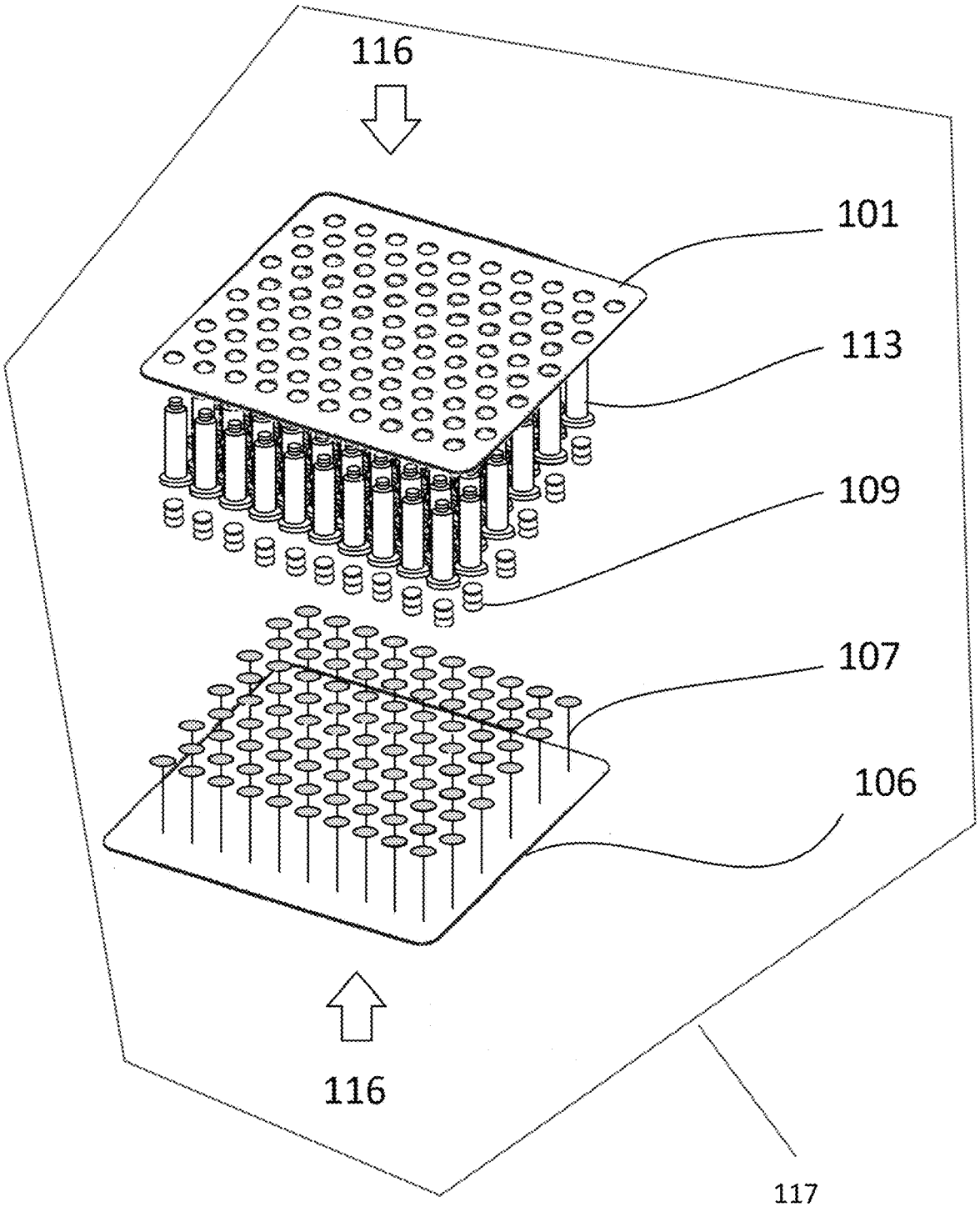
FIG. 8 shows an array of 100 pairings of elongate receptacle and charge with corresponding pusher.

FIG. 8 shows an array of 100 pairings of elongate receptacle 113 and charge 109 with corresponding pusher 107. At the top of the arrangement is a superior surface 101. The superior surface 101 has an array of 100 apertures. Below the apertures are 100 elongate receptacles 113 in a corresponding array. The elongate receptacles 113 have a screw thread at a superior aperture and an outwardly projecting flange at an inferior aperture. Below the elongate receptacles 113 are 100 charges 109 arrange in a corresponding array. Below the charges 109 are 100 elongate rods with a superior cap to act as pusher 107. The pusher 107 are in this case located on an inferior surface 106. Not shown in FIG. 8 is a slidable engagement between the superior surface 101 and the inferior surface 106 and first positioning device for keeping the elongate receptacles 113 and the charges 109 in position. In operation, a compressive force 116 is applied to bring the pusher 107 up and into contact with the charges 109. The charges 109 are pushing into the elongate receptacles 113 via the inferior aperture. The extent of upward motion of the elongate receptacles 113 is limited by abutment between superior shoulders of the elongate receptacles 113 abutting against the edges of the apertures in the superior surface 101. The movement finishes due to an abutment in the slidable engagement.

In some embodiments, array 100 is located inside a sterile container 117. Preferred sterile containers 117 are tubs, boxes, pouches and bags, or a combination of two or more thereof.

Figure 9:
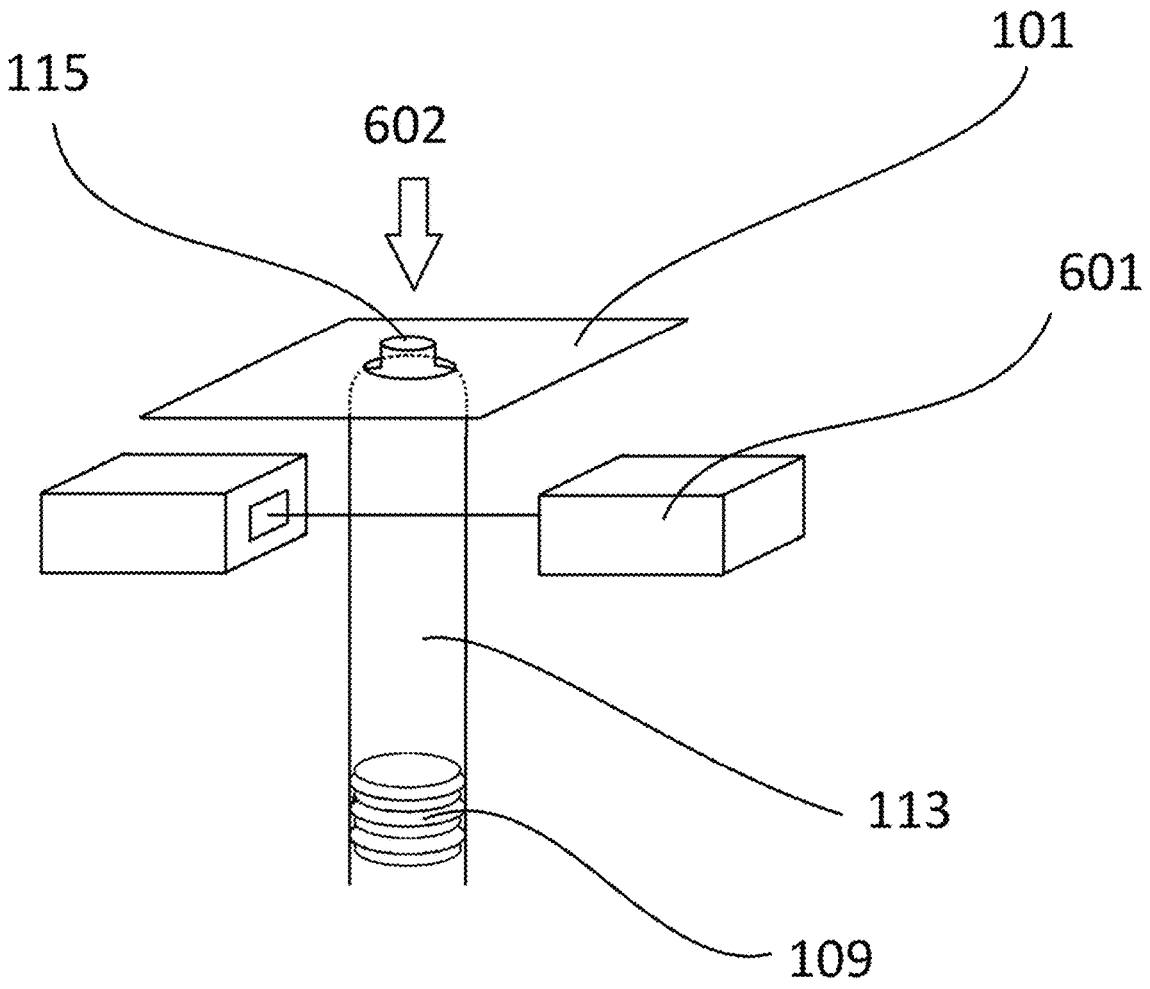
FIG. 9 shows filling of an elongate receptacle in position in the device.

FIG. 9 shows filling of an elongate receptacle 113 in position in the device. The elongate receptacle 113 is in position below the superior surface 101, against which it is abutted, with its superior aperture 115 extending above the superior surface 101 through an aperture in the superior surface 101. The elongate receptacle has previously received a charge 109, which is located close to the inferior end of the elongate receptacle 113. A laser detector 601 is positioned at a desired absolute height. A liquid pharmaceutical composition 602 is introduced into the elongate receptacle 113 via the superior aperture 115 of the elongate receptacle 113 whilst the elongate receptacle 113 remains in position in the device.

Figure 10:
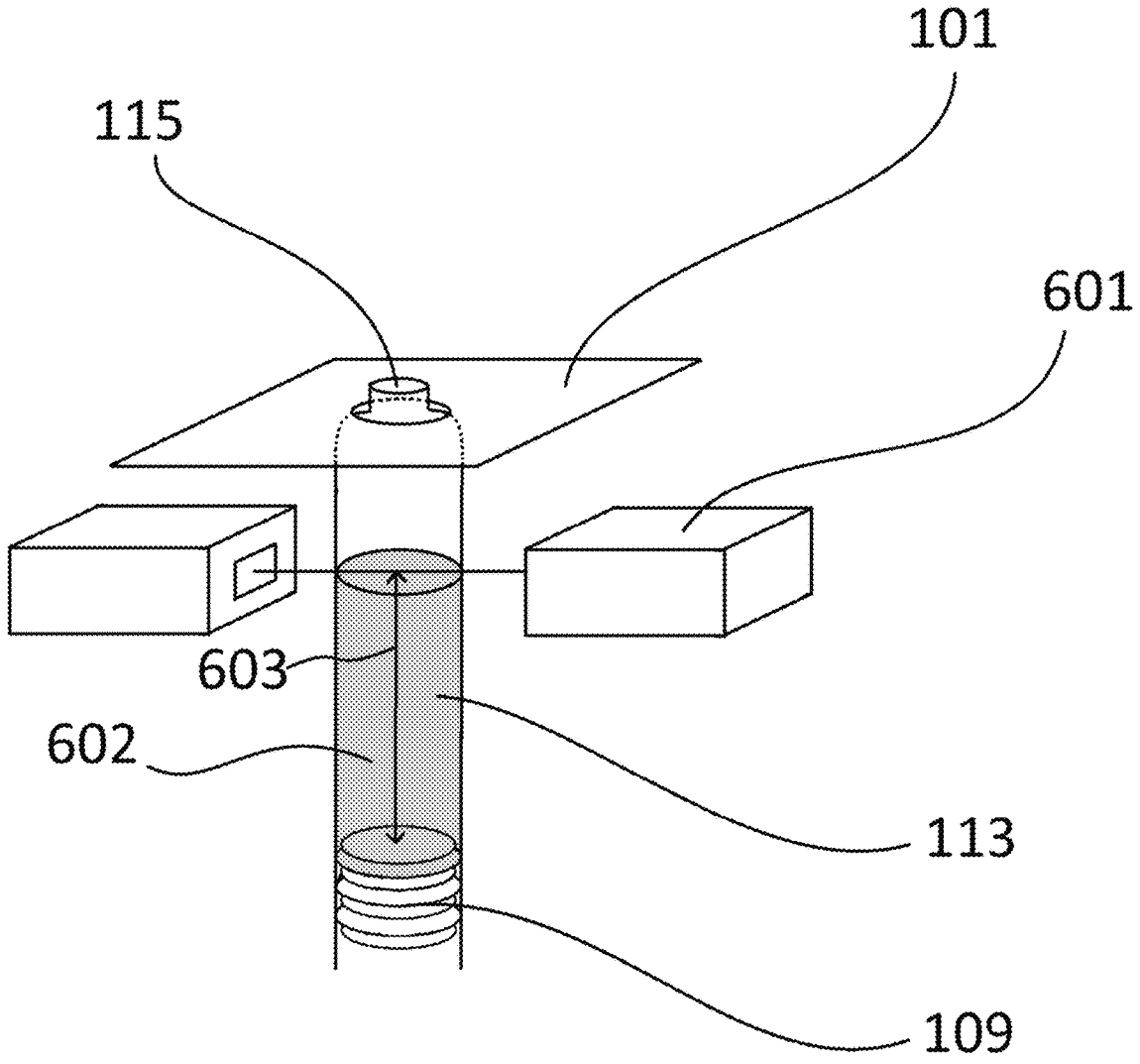
FIG. 10 shows the elongate receptacle of FIG. 9 following filling under control of a laser detector.

FIG. 10 shows the elongate receptacle 113 of FIG. 9 following filling under control of a laser detector 601. The elongate receptacle 113 has been filled with liquid pharmaceutical composition 602 up to the height of the laser detection line of the laser detector 601 to give a product fill height 603.

EXAMPLE 1

The invention is exemplified by means of not limiting examples.

A device according to FIG. 1 was provided, with elongate receptacles (cylindrical syringe barrels made of cyclic olefin copolymer) and charges (cylindrical plungers made of rubber with ribbed sides) in position. The device comprised 100 pairings of elongate receptacle and charge, position in first positioning device arranged in an array. The device was rested on a horizontal surface and a downward vertical force was applied to the superior surface until the superior part and inferior part abutted. The elongate receptacles were each filled up to a constant reference height (an absolute height) with a liquid pharmaceutical composition using a laser arrangement as presented in FIGS. 9 and 10. The superior apertures of the elongate receptacles were closed with screw tops. The product fill height was measured as the distance from the top of the charge to the bottom of the meniscus of the introduced liquid pharmaceutical composition.

EXAMPLE 2

Example 1 was repeated except with the device inverted to locate the superior surface at the underside of the device. The charges were again pushed into the elongate receptacles by the action of a vertically directed compressive force. The device was inverted to locate the superior surface at the topside of the device before continuing to filling from above and screwing on of closures to the superior ends of the elongate receptacles.

EXAMPLE 3

Comparative Example

An array of 100 elongate receptacles (identical to those of example 1) were provided in a regular array in a nest according to FIG. 6. The elongate receptacles had an end which was pre-closed with a screw cap directed downwards. The elongate receptacles were resting on the nest through abutment of an outwardly projecting flange at on an open end with the upper surface of the nest. Liquid pharmaceutical liquid was introduced into the elongate receptacle from above, followed by stoppering in a vacuum.

EXAMPLES 4 TO 6

Examples 1 to 3 were repeated except with 50 of the receptacles (with length distribution centered on 6.3 cm) replaced with a set of 50 receptacles having a length distribution centered on 7.1 cm). The receptacles were again filled to give a mean fill height of 0.055 m.

Results

Results for Examples 1 to 3 are shown in the following TABLE 1 where Mean elongate receptacle length=LM, Standard deviation of elongate receptacle length=LSD, and Mean product fill height=FM.

TABLE 1

| Example | LM [m] | LSD [m] | FM [m] | FSD [m] | (LSD · FM)/(LM · FSD) |
|---|---|---|---|---|---|
| 1 | 0.0630 | 0.00015 | 0.0550 | 0.0002 | 0.65 |
| 2 | 0.0630 | 0.00015 | 0.0550 | 0.0004 | 0.33 |
| 3 (comp.) | 0.0630 | 0.00015 | 0.0550 | 0.0010 | 0.13 |

As can be seen from the table, the inventive arrangement of example 1 produced an improved value of the fidelity parameter (LSD·FM)/(LM·FSD). A standard deviation of the produce fill height of 0.0002 m was observed in the filled elongate receptacles, despite an underlying standard deviation of 0.00015 m in the lengths of the elongate receptacles. In the second example, some additional variation in the product fill height was produced due to some movement of the charges during inversion. In the third example, a standard deviation of the produce fill height of 0.001 m was observed in the filled elongate receptacles. The third example also suffered from the detriment that a vacuum was required to avoid pressure build up in the process, because the charges were introduced into an elongate receptacle in which the opposite end was already closed with a screw cap.

Results for examples 4 to 6 are shown in the following Table 2 where Mean elongate receptacle length=LM, Standard deviation of elongate receptacle length=LSD, and Mean product fill height=FM.

TABLE 2

| Example | LM [m] | LSD [m] | FM [m] | FSD [m] | (LSD · FM)/(LM · FSD) |
|---|---|---|---|---|---|
| 4 | 0.0670 | 0.004 | 0.0550 | 0.0002 | 16.4 |
| 5 | 0.0670 | 0.004 | 0.0550 | 0.0004 | 8.2 |
| 6 (comp.) | 0.0670 | 0.004 | 0.0550 | 0.0048 | 0.687 |

As can be seen. The inventive setup provides a stable fill value even when a bivalent distribution of receptacle lengths is employed. By contrast, the bivalence of the receptacle length distribution is retained in the comparative example.

REFERENCE NUMERALS

100 Device
101 Superior surface
102 Superior abutment for elongate receptacle
103 Superior part
104 Slidable engagement
105 Inferior part
106 Inferior surface
107 Pusher
108 Cap on pusher
109 Charge
110 Inferior abutment for elongate receptacle
111 Inferior aperture (of elongate receptacle)
112 First positioning device
113 Elongate receptacle
114 Superior shoulders of elongate receptacle

115 Superior aperture of elongate receptacle
116 Compressive force
117 Sterile container
200 Integral device
201 Integral body
202 Second positioning device
203 External pusher
300 Process for producing a filled elongate receptacle
400 Prior art arrangement for stoppering from above
401 Nest for elongate receptacles
402 Outwardly protruding flange of elongate receptacle
403 Screw cap for elongate receptacle
501 Axis
502 Angle of axis with superior surface
503 Screw thread
504 Outward flange of elongate receptacle
601 Laser detector
602 Liquid pharmaceutical composition
603 Product fill height
Δz Extent of movement
F Available fill height
P1-P4 Process steps

What is claimed is:

1. A device for filling a charge into an elongate receptacle, the elongate receptacle having an upper end and lower end opposite the upper end, the device comprising:

a superior surface;

a first positioning device configured to accommodate the charge and the elongate receptacle;

a pusher moveable along a direction towards the superior surface that introduces the charge into the elongate receptacle from the lower end before the elongated receptacle is filled; and a detaining device configured to limit an extent of movement of the pusher along the direction towards the superior surface.

2. The device of claim 1, further comprising a second positioning device configured to accommodate the pusher such that the pusher and the second positioning device are moveable along the direction towards the superior surface.

3. The device of claim 2, further comprising the pusher, wherein the pusher is moveable along the direction towards the superior surface to introduce the charge into the elongate receptacle.

4. The device of claim 2, wherein the second positioning device comprises holes in an inferior surface.

5. The device of claim 1, further comprising the charge and the elongate receptacle.

6. The device of claim 5, wherein the charge comprises a thermoplastic elastomer and the elongate receptacle comprises a glass or a polymer.

7. The device of claim 5, wherein the charge comprises a material having a Young's modulus less than that of the elongate receptacle.

8. The device of claim 1, wherein the first positioning device comprises a plurality of first positioning devices each configured to accommodate a charge and an elongate receptacle, respectively.

9. The device of claim 1, further comprising a superior part and an inferior part, the superior part comprising the superior surface and the inferior part being slidably engaged with the superior part.

10. The device of claim 9, wherein the detaining device is an abutment between the superior part and the inferior part.

11. The device of claim 1, wherein the superior surface comprises a polymer.

12. The device of claim 1, wherein the device is located inside a sterile container.

13. A device for filling a charge into an elongate receptacle, comprising:

a superior surface;

an inferior surface disposed below the superior surface, the superior and inferior surfaces being held in position relative to each other so that the superior surface faces a first direction along an axis and the inferior surface faces a second direction along the axis, the second direction being opposite the first direction;

a first positioning device configured to accommodate the charge and the elongate receptacle;

a pusher moveable along the axis towards the superior surface that is configured to introduce the charge into the elongate receptacle against the force of gravity before the elongate receptacle is filled; and a detaining device configured to limit an extent of movement of a pusher along the first direction towards the superior surface.

14. The device of claim 13, further comprising a second positioning device configured to accommodate the pusher such that the pusher and the second positioning device are moveable along the axis towards the superior surface.

15. The device of claim 14, wherein the second positioning device comprises holes in the inferior surface.

16. The device of claim 13, wherein the superior surface and the inferior surface are slidably engaged with one another for movement along the axis.

17. The device of claim 16, wherein the detaining device is an abutment between the superior surface and the inferior surface.

* * * * *